US005211038A

United States Patent [19]

Valent

[11] Patent Number: 5,211,038

[45] Date of Patent: May 18, 1993

[54] BALLASTED TUB FOR WASHING MACHINES

[75] Inventor: Lucio Valent, Pordenone, Italy

[73] Assignee: Zanussi Elettrodomestici S.p.A., Pordenone, Italy

[21] Appl. No.: 827,360

[22] Filed: Jan. 29, 1992

[30] Foreign Application Priority Data

Jan. 30, 1991 [IT] Italy ..... 000004 A/91

[51] Int. Cl.[5] ..... D06F 37/22

[52] U.S. Cl. ..... 68/23.2

[58] Field of Search ..... 68/23.2, 142, 144, 3 R, 68/23.1, 24; 210/363, 364

[56] References Cited

FOREIGN PATENT DOCUMENTS

| | | | |
|---|---|---|---|
| 0152745 | 8/1975 | European Pat. Off. | 68/3 R |
| 1084649 | 6/1960 | Fed. Rep. of Germany | 210/363 |
| 1236457 | 3/1967 | Fed. Rep. of Germany | 68/144 |
| 2044298 | 10/1980 | United Kingdom | 68/23.2 |
| 2157326 | 10/1985 | United Kingdom | 68/3 R |
| 2182353 | 5/1987 | United Kingdom | 68/3 R |

*Primary Examiner*—Philip R. Coe

*Attorney, Agent, or Firm*—Pearne, Gordon, McCoy & Granger

[57] ABSTRACT

A ballasted tub for washing machines, particularly clothes washing machines or combined clothes washing and drying machines. Two circular shells (9, 10) of plastic material are adapted to be fitted and connected with each other along their periphery and are shaped in such a way as to be adapted to accommodate a plurality of ballast blocks (8) made of concrete or other suitable heavy material. The ballast blocks (8) are pre-formed and applied against the corresponding front and rear surfaces of the shells (9, 10) with fasteners (22, 23, 24, 25, 27, 31, 32) of a known type, thereby implementing a ballasted tub with a modular structure, wherein both the disposition and the combination of the ballast blocks (8) can be varied at will to balance differently shaped and sized tubs therewith.

1 Claim, 4 Drawing Sheets

BALLASTED TUB FOR WASHING MACHINES

BACKGROUND OF THE INVENTION

1. Field of the Invention

The invention relates to a ballasted tub for washing machines, in particular clothes washing machines or combined clothes washing and drying machines, said tub being designed in a structurally rigid way and being provided with a quick and simple system for fastening the various ballast masses in position.

2. Description of the Prior Art

Washing machines provided with ballast masses applied to the wash tub in different manners are known from the prior art.

According to one of these prior art embodiments shown, for example, in German Patent 1,186,413, the ballast is formed by a previously prepared concrete block or masses of heavy material of any suitable kind, which are fixed to the front wall of the tub of the washing machine by removable fastening means such as screws, bolts, nuts, washers and the like.

In all these cases, however, the presence of several fastening means of various kinds makes such a ballast mounting complicated in its design and construction and leads to difficulties and inconveniences in assembling the tub.

According to another prior art embodiment, the ballast comprises a molded plastic flange forming the front wall of the tub and being in the shape of a continuous grooved ring having a U-shaped cross-section profile, which is adapted to accommodate a concrete mass, said flange being further provided with a plurality of radial ribs formed on it corresponding to the open front surface of the same flange, so as to retain in its seat the concrete mass that is poured into the cavities resulting between said continuous ring and the respective radial ribs. The flange with the concrete ballast applied thereby is subsequently applied against the curved edge of the cylindrical mantle of the tub by means of a clamping ring which is fitted into the corresponding perimetric groove of said flange after interposing a sealing gasket therebetween.

In practice, this type of tub design has the drawback of being constructively complicated, due to the need to first manufacture the plastic flange and then cast the concrete in the cavities of the same flange, which further prevents the ballast from being given a modular design so as to generate the possibility of adapting the same ballast to balancing applications in connection with differently shaped and sized washing machine tubs, which can be installed in different types of washing machines.

Furthermore, such concrete masses can undesirably become loose and come off their seats in said molded plastic flange, so that these masses will fall outside the flange itself, due to the effect of both the vibrations generated during the operation of the washing machine and the shrinkage of the concrete inside said seats.

SUMMARY OF THE PRESENT INVENTION

It is therefore the purpose of the present invention to eliminate all of the afore cited drawbacks by providing a washing machine with a ballasted tub that is made to ensure an effective, reliable support to the concrete ballast mass, which can also be made to a modular design concept for adaptation to differently shaped and sized tubs, as well as to ensure a quick and simple assembly of said ballast on to the front wall of the tub.

Such a ballasted tub is embodied with the design and construction characteristics as essentially described and defined with particular reference to the appended claims.

BRIEF DESCRIPTION OF THE DRAWINGS

The invention will be further described by way of nonlimiting example with reference to the accompanying drawings in which.

DESCRIPTION OF THE PREFERRED EMBODIMENT

Referring now to the FIGS. 1 and 2, both of them show a ballasted washing machine tub 7 which is adapted to hold and support ballast masses 8 against its front and rear walls in the hereinafter described way, and which is also adapted to be mounted inside a cabinet (not shown) of a clothes washing machine or a combined clothes washing and drying machine.

Figure 1:
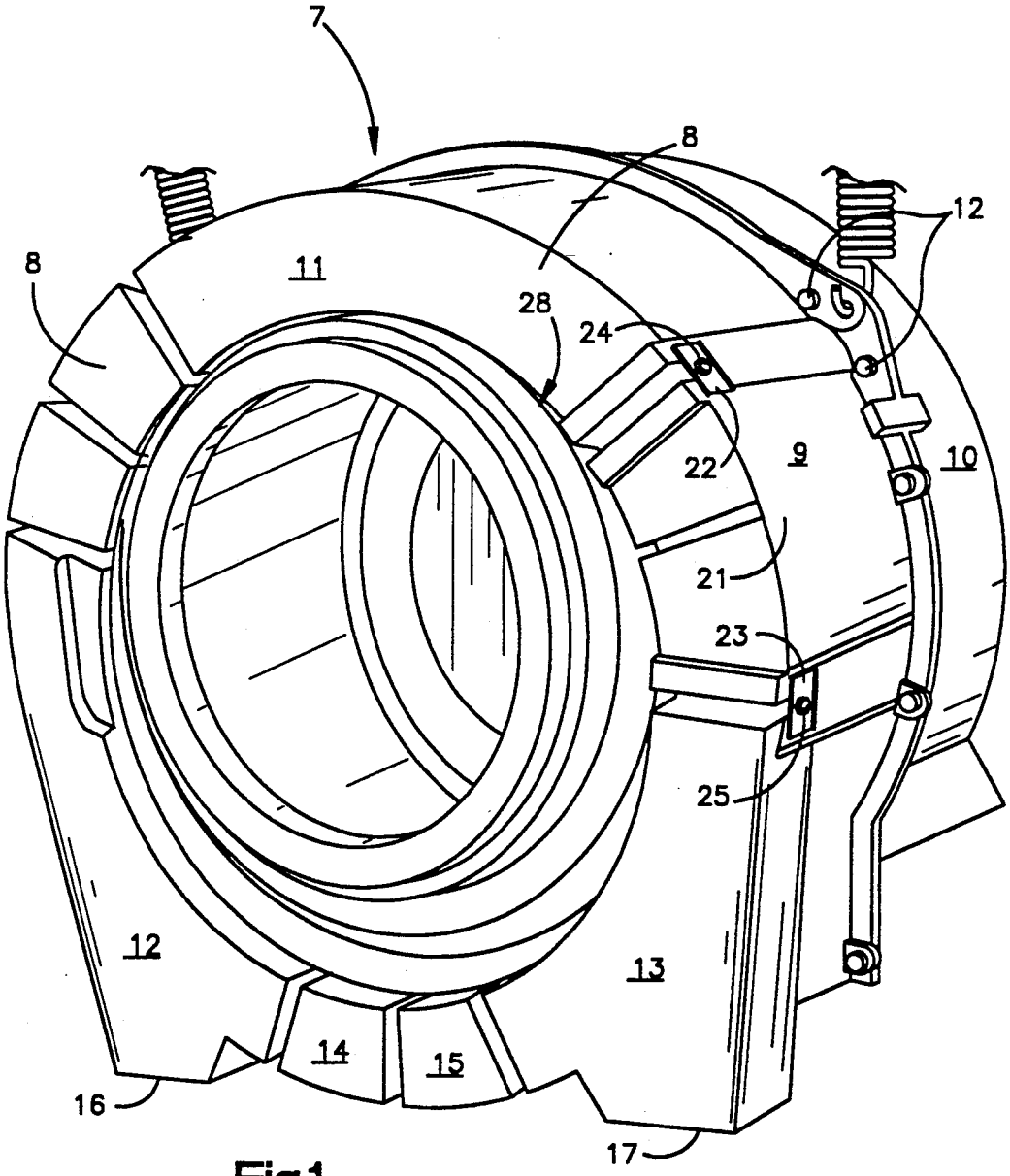
FIG. 1 is a perspective view of the front portion of a ballasted washing machine tub according to the invention.
Figure 2:
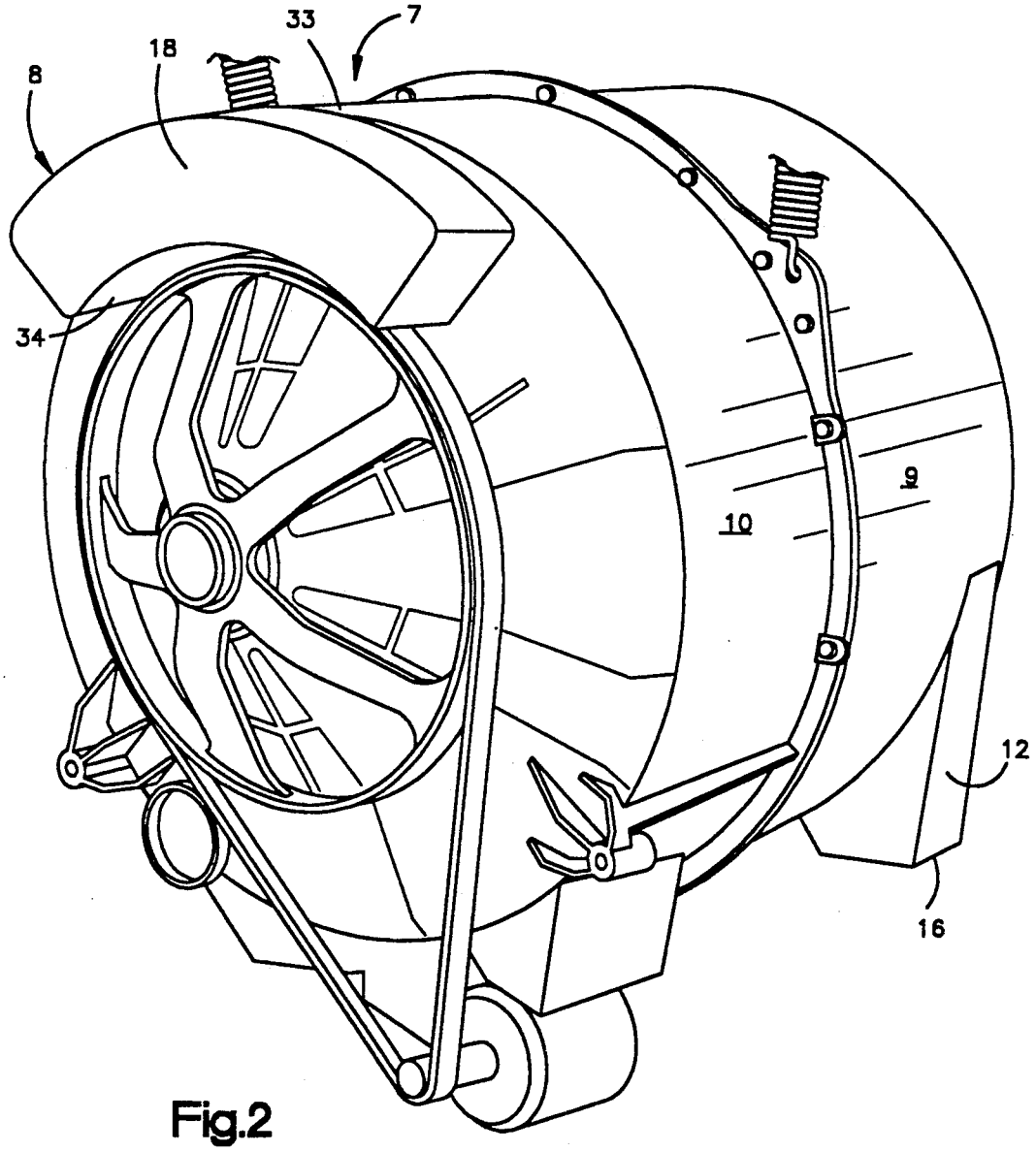
FIG. 2 is a perspective view of the rear portion of the ballasted washing machine tub as in FIG. 1.

Furthermore, as it appears from FIGS. 1 and 2, the tub 7 is made of plastic material and is formed by two shells 9 and 10 which are mutually adaptable and connectable along their respective circumferential surfaces, known fastening means such as threaded bolts 5, screws and the like, where seats for both the upper suspension springs 6 of the tub-and-drum assembly and the lower shock absorbers (not shown) are also provided.

The ballast masses 8 are formed by a plurality of pre-formed blocks of heavy material, such as concrete or the like, which are preferably made in the form of sectors of a circle having similar thickness and height, and shaped to be capable of being fitted and fixed in a mutually adjoining, end-to-end arrangement against the respective, front and rear shells 9 and 10 of the tub 7. In particular, in this example of an embodiment of the tub according to the invention, the front-side ballast appears as being formed by three preformed blocks 11, 12 and 13, i.e. an upper block 11 in the shape of a sector of a circle and two lower blocks 12 and 13 that are each symmetrical to each other and are provided with a portion in the shape of a sector of a circle 14, 15 and an enlarged portion of a downwards tapered shape 16, 17, respectively.

The rear-side ballast appears in turn as being formed by a single upper block 18 (see FIG. 2) in the shape of a sector of a circle.

Figure 4:
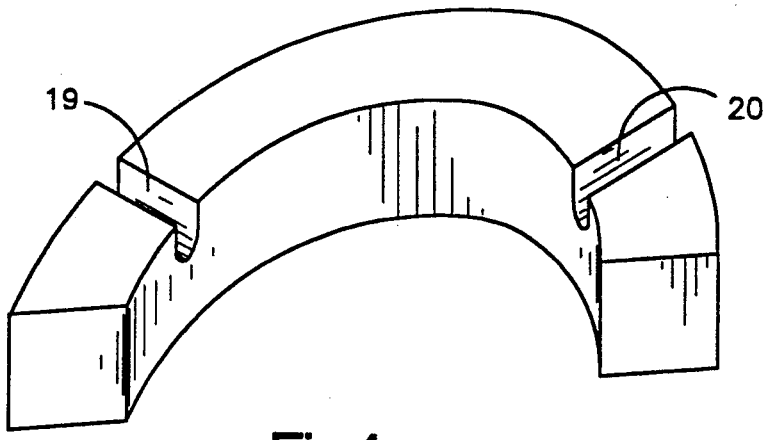
FIG. 4 is a view of construction details of a ballast block according to the invention.

Furthermore, as it quite clearly emerges in particular from FIG. 4, where a ballast block in the shape of a sector of a circle is illustrated, each block of this kind is provided with two grooves 19 and 20 running along the full height of said block in a transverse direction with respect to the same block to enable it to be fastened in position in the hereinafter described way.

Figure 5:
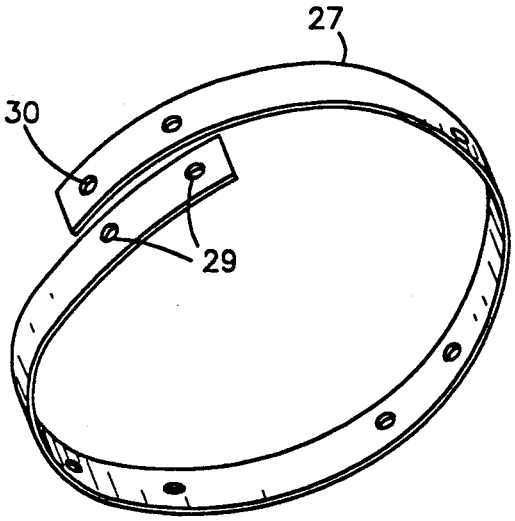
FIG. 5 is a perspective view of a metal band according to the invention.
Figure 6:
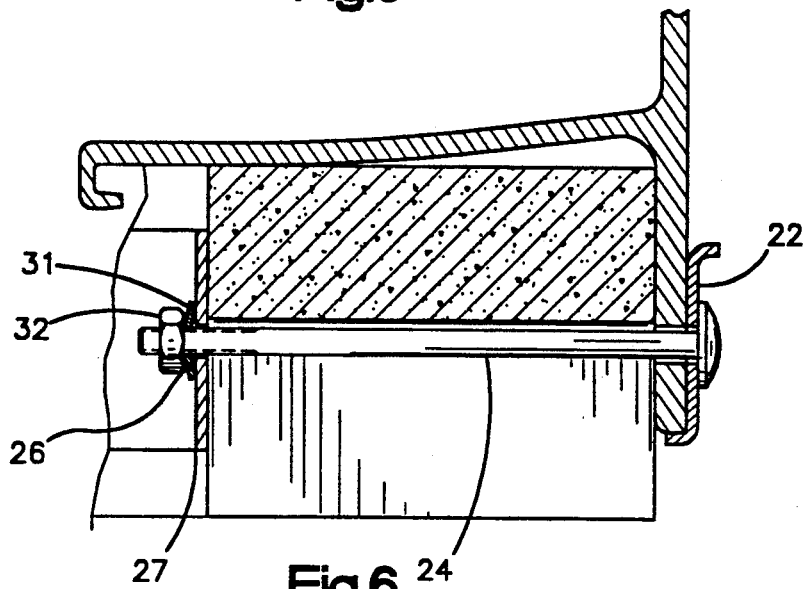
FIG. 6 is a side cross-sectional view of fastening details of the ballasted washing machine tub as in FIG. 1.

Referring now to the FIGS. 1, 5 and 6, these illustrate the way in which the blocks forming the front-side ballast are applied and fixed in position.

From the above cited Figures it can be seen that, the front shell 9 of the tub 7 is provided with three portions protruding frontally from said tub (only the portion 21 is shown in FIG. 1) in correspondence to an outer circumferential edge of each ballast block, each one of said protruding portions being capable of accommodating two square-shaped metal plates 22 and 23, through the threaded holes of which respective bolts 24, 25 can be inserted for fixing the various ballast blocks. Each ballast block is furthermore sized to perfectly adapt and fit against the front shell 9 of the tub 7 in a position lying underneath the respective protruding portion of the same tub, and its transversely running grooves 19 and 20 are in such a position that, when said block is applied in its seat, the grooves fall in line with the respective bolts 24, 25 to enable the bolts to pass through.

In practice, each one of the above described fixing bolts is inserted through its respective square plate and transverse groove, as well as through a corresponding slot-shaped hole 26 provided in a circular metal band 27 (see FIGS. 5 and 6), which is applied all around the front opening 28 of the tub 7, against the inner surface of the respective ballast block, said metal band being provided at its ends with respective slots 29 and 30 coinciding with each other so as to enable said band ends to be mutually connected by known fastening means (not shown), in such a way that said metal band will be capable of being adapted to ballast blocks having differing diameters.

The free threaded end of each bolt is then inserted through a washer 31 or similar means, and on the same washer or similar means is finally screwed a corresponding lock nut 32, thereby causing each single ballast block to be firmly applied and fastened in position, without any possibility of becoming later displaced with respect to the other ballast blocks fixed in the same way.

The block forming the rear ballast is in turn housed in a seat which is obtained between an upper circular portion 33 and a lower circular portion 34, both protruding from the rear wall of the tub 7, while said ballast block is then secured to the tub assembly as in the preceding case of the front ballast blocks, by square metal plates arranged on said upper and lower portions, as well as the described bolt and lock-nut system, wherein each bolt is inserted through a respective transversal groove in the same block.

Figure 3:
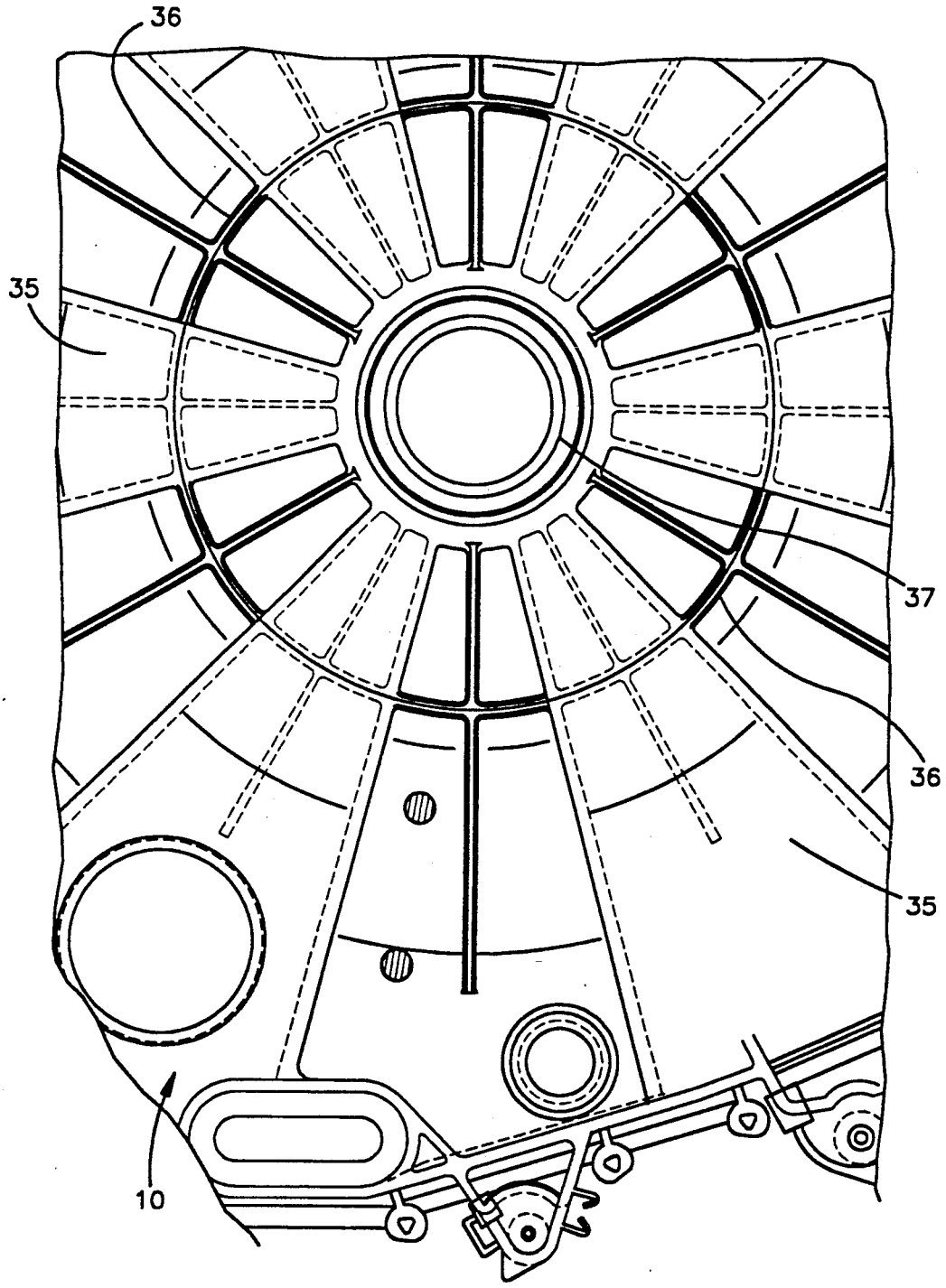
FIG. 3 is the view of a construction detail of the center of the rear side of the ballasted washing machine tub as in FIG. 2.

By looking now at the FIG. 3, it can be finally seen that the above cited ballasted tub is further provided on the outer surface of its rear shell 10 with a plurality of radial ribs 35, which are identical and distributed regularly along a circular direction, as well as at least one circular rib 36 having a greater radius than the hub 37 (ensuring the passage of the drum driving shaft, not shown), said circular rib blending into said radial ribs so as to give the tub a rigid structure with a high mechanical strength to adequately withstand the stresses imposed by the drum rotating at its regular wash and spin-extraction speeds.

The ballasted tub provided in this way according to the invention ensures an effective and reliable supporting means for the various ballast masses and, due to the modular concept according to which said masses are designed, it is possible to vary their arrangement and set-up according to the particular type of tubs being handled, so as to be able to balance differently sized and shaped, separately manufactured wash tubs by just using different combinations of the same ballast masses.

I claim:

1. A ballasted tub for a washing machine comprising two shells made of plastic material which shells are connectable to each other, the first shell having a front wall and the second shell having a rear wall to which walls a plurality of ballast masses can be fastened, characterized in that each of said ballast masses (8) comprises a preformed block having at least two grooves (19, 20) extending transversely across said block and being removably fitted against said tub by fastening means (22, 23, 24, 25, 27, 31, 32), said fastening means comprising a metal plate having a hole therein (22, 23), a threaded bolt (24, 25), a metal band (27) having a plurality of holes therein and applied against said ballast masses (8), said threaded bolt (24, 25) being insertably located through substantially concentric holes in said metal plate (22, 23) and in said metal band (27), as well as through one of said transverse grooves (19, 20) provided in each ballast mass (8), said bolt being secured in place by a washer (31) and a lock nut (32) to hold the block between the metal plate and the metal band.

* * * * *